United States Patent [19]

Coursen et al.

[11] Patent Number: 4,586,438

[45] Date of Patent: May 6, 1986

[54] BOREHOLE STEMMING WITH A COLUMN OF LIQUEFIABLE AND/OR VAPORIZABLE CHUNKS OF SOLID MATERIAL

[75] Inventors: David L. Coursen, Wilmington, Del.; James D. Heffner, Aiken, S.C.

[73] Assignee: E. I. Du Pont de Nemours and Company, Wilmington, Del.

[21] Appl. No.: 652,268

[22] Filed: Sep. 20, 1984

Related U.S. Application Data

[63] Continuation-in-part of Ser. No. 551,473, Nov. 14, 1983, abandoned.

[51] Int. Cl.[4] ..... F42B 3/00

[52] U.S. Cl. ..... 102/313; 102/312; 102/333; 86/20 C; 299/13; 166/302

[58] Field of Search ..... 102/312, 313; 86/20 C; 299/13; 166/302

[56] References Cited

U.S. PATENT DOCUMENTS

| | | | |
|---|---|---|---|
| 2,707,436 | 5/1955 | McCool | 102/313 X |
| 3,952,655 | 4/1976 | Kusakabe et al. | 102/313 |
| 3,978,921 | 9/1976 | Ross | 166/212 X |
| 4,010,810 | 3/1977 | Ross | 166/303 |
| 4,071,099 | 1/1978 | Hensel, Jr. | 175/226 X |
| 4,241,592 | 12/1980 | Tapphorn | 250/261 X |
| 4,295,760 | 10/1981 | Warner | 411/33 X |

*Primary Examiner*—Peter A. Nelson

*Attorney, Agent, or Firm*—Diamond C. Ascani

[57] ABSTRACT

To prevent the rapid escape of high-pressure explosion gases when an explosive charge is initiated in a borehole, the hole is stemmed with chunks of readily liquefiable and/or vaporizable solid material, preferably chunks of ice and/or chunks of dry ice, piled up one upon the other so as to form a columnar bed of presolidified stemming material. The column remains in place during the explosion, and thereafter disappears by melting and/or subliming on absorbing heat from the surrounding formation. A preferred stemming column comprises a combination of ice chunks and chunks of dry ice, e.g., wherein the ratio of dry ice to ice in the column decreases with distance from the explosive charge.

27 Claims, 1 Drawing Figure

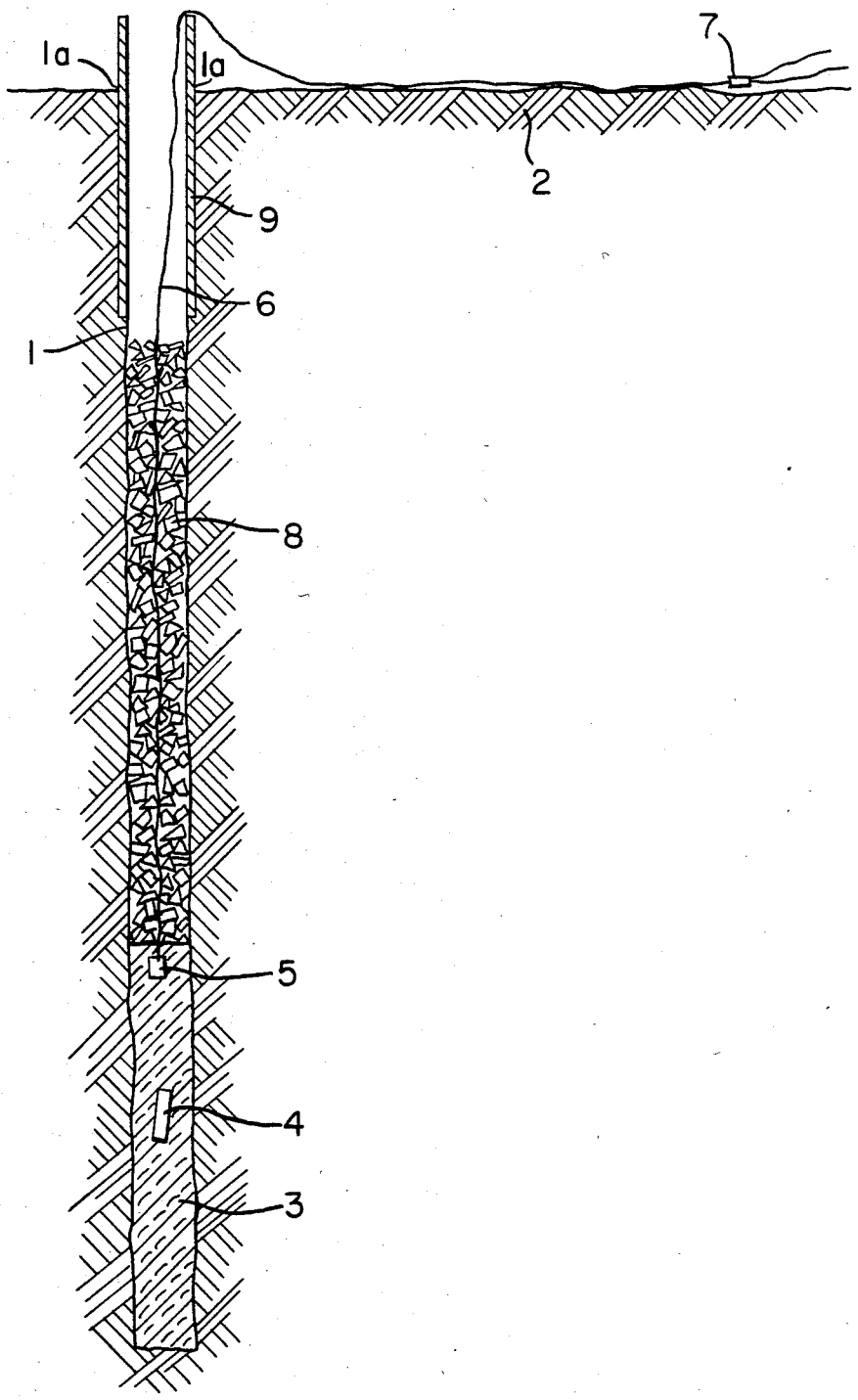
1a
1a
7
2
9
6
1
8
5
4
3

BOREHOLE STEMMING WITH A COLUMN OF LIQUEFIABLE AND/OR VAPORIZABLE CHUNKS OF SOLID MATERIAL

CROSS REFERENCE TO RELATED APPLICATION

This application is a continuation-in-part of co-pending application Ser. No. 551,473, filed Nov. 14, 1983, now abandoned.

BACKGROUND OF THE INVENTION

1. Field of the Invention

The present invention relates to a method of stemming boreholes, i.e., to a method of blocking the exit of holes which contain an explosive charge to prevent the rapid escape of the high-pressure gases produced when the charge is exploded and therefore allow more effective utilization of the explosive energy.

2. Description of the Prior Art

A well-known method of fracturing rock involves drilling a hole in the rock, placing an explosive charge in the drilled hole, and firing the charge. The effectiveness of the explosion in extending long, gas-pressured fractures out into the rock surrounding the hole is increased by blocking the exit of the hole so that the high-pressure gases cannot rapidly escape through the collar of the hole. This procedure increases the duration of high gas pressure in the hole and thereby allows more high-pressure gas to enter fractures in the rock so as to extend and widen them. The undesired escape of gas from the collar of the hole usually is prevented by filling at least part of the empty portion of the hole between the explosive charge and the collar with clay, sand, gravel, drill cuttings, or water. This material is called "stemming" and its emplacement is called "stemming the hole".

In the blasting of deep ore bodies with explosive charges preparatory to the leaching of the ore in place, a shot hole may have neighboring holes that are not charged with explosive. The effectiveness of an explosion in such a shot hole may be reduced by the escape of explosion gases from the neighboring holes, and thus it may be desirable to stem them as well as the shot hole.

In some situations, for example when gas, oil, or water wells are being stimulated with explosives, or deep ore is being blasted preparatory to being leached in place, it is necessary to remove the stemming after the blast so that another, larger charge may be placed in the cavity produced by the previous charge, or so that oil, gas, water, copper, uranium, or other mineral values may be extracted from the hole, or so that lixiviant solutions may be pumped down the hole to extract mineral values from the surrounding rock. In other cases, removal of the stemming may be desired in order to allow a failed charge to be reprimed.

Solid stemming generally is removed by drilling it out or by blowing it out with compressed air. Such an operation may be potentially hazardous if an unshot charge lies below the stemming, and, in any case, it is expensive. Also, the driller may not stop drilling when he has reached the base of the stemming, but may continue drilling into the hole interval that has been stimulated by the explosion. This can plug the fractures generated by the explosion and thereby damage the well.

U.S. Pat. No. 2,707,436, issued to H. D. McCool, describes a method of fracturing a subsurface formation with an explosive charge wherein a solid plug of frozen fluid is to be formed in the borehole above the charge to provide stemming. A fluid such as water or a drilling mud is introduced into the hole, and thereafter is to be cooled and frozen to form a solid columnar plug. The explosive charge is to be detonated while the plug is solid. Removal of the plug is accomplished simply by allowing it to melt by absorbing the heat resulting from the explosion and the heat from the formation itself. This technique avoids the necessity of post-explosion drilling but suffers from several disadvantages. First, the stemming required may be on the order of about 30 meters in length. A large amount of fluid must be introduced into the hole and some of this undoubtedly will be absorbed into the surrounding formation, with possible deleterious effect on the fluid conductivity of the fractures produced by the explosion when the rock contains clays that can swell by absorbing the fluid introduced for plug formation. Such swelling of the rock and the associated softening and decrepitation thereof can cause closure or plugging of the fractures. Such effects are common when water is the fluid.

Also, depending on the location and nature of the formation, the ambient temperature of the rock surrounding the hole may well be in the range of about from 30° C. to 50° C. It may be very difficult to cool the long column of fluid down to the vicinity of its freezing point, to freeze the entire column solid, and to keep it in the frozen condition for several hours as is often desirable before firing the charge. If a layer of the fluid at its interface with the warmer wall of the hole should remain unfrozen, or become so, before the explosive charge is fired, the explosion gases may eject the entire plug from the hole, obviously destroying its effectiveness. Furthermore it is relatively difficult to control and predict the condition of such stemming over time because its state is determined first by a freezing process and then a melting process.

According to the aforementioned U.S. Pat. No. 2,707,436, an endothermic reactant, preferably dry ice, is introduced into the fluid material standing in the borehole, in an amount sufficient to freeze the fluid material. The endothermic reactant is used as a coolant in the process of the plug's formation, and escapes as a gas during the freezing process. The patentee stresses the importance of (a) having an impervious solid plug which fills all cavities and irregularities in the borehole wall, and (b) forming the solid plug by freezing the fluid material in the borehole, which is indicated to give good friction hold due to the expansion of the fluid on freezing.

SUMMARY OF THE INVENTION

The present invention provides an improvement in a method of stemming boreholes wherein the stemming is of the type which is removable by its thermally induced change of state. The method of the invention comprises delivering, e.g., dropping or lowering, into a hole in a subsurface formation, at a substantially liquid-free location between the collar of the hole and the top of an explosive charge therein, frozen chunks of at least one readily liquefiable and/or vaporizable solid material, preferably ice ($H_2O$) or dry ice ($CO_2$) or a combination thereof, and allowing the chunks to pile up one upon the other and form a columnar bed of pre-solidified material, said solid material having a melting or sublimation temperature at one atmosphere pressure that is (a) sufficiently high that the column of chunks remains in place until, while, and for a period of time after, the charge explodes, and (b) sufficiently low, i.e., below the ambient temperature of the formation, that, after the explosion, the column melts and/or sublimes on standing.

In a preferred process of the invention, wherein the hole to be stemmed is located in a formation having a temperature in the range of about from 5° C. to 50° C., the stemming column consists, at least in part, of a combination of chunks of ice ($H_2O$) and chunks of dry ice ($CO_2$), the weight ratio of $CO_2$ ice to $H_2O$ ice in the initially formed column being about from 1/1 to 2.3/1. This ratio will gradually decrease as the dry ice sublimes.

After the explosion has occurred, the stemming is removed merely by allowing it to remain in place while it warms up by contact with the formation. If there is sufficient gas pressure in the cavity below it, it will blow out after a sufficient amount of it has reverted to the fluid state. If there is insufficient gas pressure in the cavity to produce this delayed blowout, the stemming eventually will all revert to liquid or gas. In either case, a clear passage will remain, which will extend from the collar of the hole down into the shot zone. In some cases this passage may contain melted stemming and in other cases no melt will remain. In any case, no operations are required to remove the stemming in order to gain access to the cavity below it.

The term "chunks of solid material" as used herein to define the material that is introduced into the hole to form the pre-solidified stemming column denotes material in a form commonly referred to as lumps, chunks, cubes, nuggets, or blocks. The term is meant to exclude particulate matter of the size of sand, for example, and generally denotes a diameter or other minimum dimension of at least about 5 millimeters but less than the hole diameter. Examples are ice cubes, dry ice nuggets, and prisms or cylinders of dry ice or ice just small enough to pass down the hole.

BRIEF DESCRIPTION OF THE DRAWING

The accompanying drawing is a schematic representation of a loaded borehole stemmed according to the method of the invention and prepared for firing.

DETAILED DESCRIPTION

In the present method the liquefiable and/or vaporizable stemming material(s) are placed into the hole above the explosive charge in the pre-solidified form as solid pieces generally designated by such terms as "lumps", "chunks", "nuggets", "billets", or "blocks". Ordinary ice cubes, for instance, constitute such pieces. Because the stemming material is pre-solidified, the problem of the clogging of fractures in the formation with liquid is avoided, and the complex task of freezing a large body of fluid in a warm environment is unnecessary. Surprisingly, the stemming column remains in place during the explosion despite the fact that it is not an impervious solid plug, and that the stemming material is not introduced as a fluid that is caused to be frozen in the borehole whereby expansion can take place. It is nevertheless true that the less void space the plug contains, the shorter it can be.

If the chunks of ice or dry ice are too small, they may be blown back out of the hole by the flow of $CO_2$ gas from subliming dry ice already in place; and, if the hole is very deep, and particularly if it is very warm, chunks that are too small can completely melt or sublime before reaching bottom. Therefore, chunks of ice or dry ice with a minimum dimension less than 5 mm should comprise at most a minor fraction of the chunks put in the hole.

If the chunks of ice or dry ice are too large, they will, of course, not fit in the hole at all. It is possible to make them of the maximum workable size, which is in the form of spheres, cylinders, or ellipsoids having a minimum cross-section that is circular with a slightly smaller diameter than the hole. Their shape in this case can by any regular or irregular shape that is obtainable. Suitable cylinders of ice can be made by freezing hanging cylindrical bags of water having a diameter less than that of the hole and then stripping off the bags. A convenient form for the ice chunks is commercially available ice "cubes" which may actually have the form of cubes, but may also be in the form of cylinders, truncated cylinders, truncated cones, or other shapes. Convenient forms for the dry ice chunks are commercially available dry ice "nuggets" which are cylinders of approximately 6 to 25 mm diameter and of random length ranging from about 0.6 to about 5 cylinder diameters, or dry ice billets formed by cutting large blocks of dry ice with a band saw.

The choice of stemming material will depend upon the ambient temperature of the surrounding rock. If the ambient temperature is above the melting point of sulfur, as may be the case in a geothermal well, then chunks of sulfur ranging in size from billets down to lumps having a minimum dimension of about from 6 to 38 millimeters and below their melting point (120° C.) may be used as stemming. In cooler wells, chunks of ice (in the form of billets or ordinary ice cubes, for example), or chunks of dry ice (commercially available, for example, in the form of billets or of random-length cylinders, 6 to 25 millimeters in diameter, called "nuggets") may be used. When the ambient rock temperature is 5° C. to 50° C., a mixture of ice chunks ($H_2O$) and dry ice chunks ($CO_2$) is preferred wherein the weight ratio of $CO_2$ ice to $H_2O$ ice is about from 1/1 to 2.3/1. During the time between the emplacement of the stemming and the explosion of the charge, the proportion of dry ice to water ice becomes less as the dry ice sublimes. With the specified mixture in holes having an ambient temperature of 20° C. to 50° C., however, the dry ice sublimes at a much lower rate than it does when the stemming is 100% dry ice, and the low temperature of the water ice in such stemming makes it mechanically stronger and less subject to bridging in the hole than water ice that is melting.

It is preferred to fire the explosive charge before all of the dry ice has sublimed in such stemming and before the water ice has been warmed to its melting point. Therefore, such stemming preferably is emplaced rapidly and the charge shot without undue delay. The time interval, t, that elapses between the emplacement of a section of the stemming and the time when all of the water ice in that section has warmed to its melting point decreases both with increasing temperature of the rock and decreasing borehole diameter. For a 15-cm-diameter hole in rock at an ambient temperature of 40° C. (typical of the temperature in a gas well), t is several hours.

When the diameter of the borehole is so small, or the ambient temperature of the rock is so high, that t is inconveniently short for emplacing the stemming and exploding the charge, t may be increased by pre-cooling the rock with a charge of dry ice chunks. After all or most of this charge has sublimed, the stemming may be emplaced.

In a preferred method of stemming emplacement, the explosive charge is first loaded into the hole and then provided with an explosive booster that is initiated either by one or more time bombs placed adjacent to the booster, or by one or more detonating cords run down the hole from its collar. If detonating cords are used, they preferably are of the low-energy type so that the detonation of the cord does not disturb the stemming or cut off adjacent detonating cords in the same hole.

The amount of ice/dry ice stemming required to hold in place may be reduced by emplacing an optional section of wadding, typically 5–10 hole diameters thick, just on top of the explosive charge, to reduce the penetration of hot explosion products into the interstices of stemming. The wadding can be composed of any of a wide variety of materials such as clay, gravel, sand, vermiculite, mica, fly ash, sawdust, wood chips, bark chips; natural or synthetic fiber such as cotton, jute, hemp, wood pulp, nylon, or polypropylene, in bulk form or in the form of roving, cord, rope, fabric, or paper; chopped cellophane, polyethylene, or polyester film, starch, sugar, ground rubber, or water-soluble salts such as calcium chloride, sodium chloride, and sodium bicarbonate. A preferred wadding comprises water temporarily gelled with a crosslinked water-soluble polymer. An example of such a material is available from Dowell under the trade name "Protectozone". The stemming is then emplaced, e.g., by alternately or simultaneously dropping ice chunks and dry ice chunks down the hole in the desired proportions, at the maximum rate that will avoid bridging of the stemming in the hole.

The entire stemming column need not be of uniform composition. For example, part of the column can be water ice chunks, part of it dry ice chunks, and part of it a mixture of the two.

In wells having water-sensitive clays or shales in the production zone it is good practice to introduce as little water as possible into the well during drilling or stimulation. Accordingly, it may be desirable to use 100% dry ice chunks for the bottom section of the stemming, a mixture of dry ice chunks and water ice chunks above that, and optionally a top section of 100% ice chunks. Such stemming will be coldest at the bottom. Any water formed by the melting of ice chunks in the upper parts of the stemming will re-freeze before it can run through the bottom of the stemming and into the well. As the stemming warms up, the bottom section will release last and gas pressure in the well will then blow out the stemming, including the water in it.

In holes that already contain some water in the interval to be stemmed, dry ice chunks may be dropped or delivered down the hole and into the water in sufficient amount to freeze the water, and the remainder of the stemming may be of the aggregate type according to the invention.

The minimum amount of stemming that will hold in place during the explosion of a given charge of explosive varies with the temperature and roughness of the hole, the composition and particle size of the stemming, and the in situ stress on the rock, which determines the rate at which the explosion pressure is reduced by the flow of explosion products into the fractures produced by the explosion. For stemming that is 60% dry ice nuggets and 40% water ice cubes, and an explosive charge that is at least two hole diameters in length, a stemming column that is 110 hole diameters in length will hold in place about 50% of the time, and a column that is at least 140 hole diameters in length will hold in place reliably, when the ambient rock temperature is 10° C. and the in situ compressive stress on the rock is low.

If the well is not more than a few hundred feet deep, the dry ice nuggets and ice cubes preferably are emplaced by pouring them down the well through a funnel having a smaller diameter than the well. The funnel limits the rate of flow and thereby reduces the risk of having the ice chunks bridge in the hole. But if the well is a few thousand feet deep, a substantial portion of the ice cubes and dry ice nuggets will melt and sublime during free fall down the hole. In this case, they can be lowered in a bag or capsule and dumped out in place. Alternatively, larger chunks of ice and dry ice that can survive the free fall may be used.

When rock in the section of well to be shot is under relatively high compressive stress, the explosion products are slower to drain off through fractures and therefore the stemming must hold in place against a pressure of longer duration. This situation is usually encountered in deep holes such as gas wells. Under these circumstances, the amount of stemming required to hold in place can be inconveniently large if it contains an appreciable amount of void space. The amount of void space can be reduced by using ice and dry ice in the form of billets (say, 1–50 kg apiece) and emplacing them by dropping them down the hole. The impact of a billet on the bottom fractures it, compresses it and the underlying materials, and collapses voids. A stemming column of high density and holding power results. As it falls, contact of a billet with the warm hole wall can cause substantial attrition of the billet. This undesirable effect can be reduced by putting the billets in net bags before dropping them or by freezing transversely projecting members into the ice billets. Such members, preferably of a tough plastic such as polyethylene, act as centralizers to reduce contact of the falling billet with the hole wall. Preferable forms of such members are straight or curved rods or laths, with their centers embedded in the billet and their ends projecting, or with their ends embedded in the billet and their centers projecting.

It is preferable that the chunks of ice to be introduced into the hole be in a very cold condition. For example, they preferably are chilled with dry ice before loading. They may be stored, for example, in insulated boxes containing a perforated partition that divides the storage volume of the box into two parts. Chunks of dry ice (dry ice nuggets, for example) can be stored on one side of the partition, and chunks of ice (bags of ice cubes, for example) on the other. The dry ice keeps the ice chunks very cold until it is time for them to be loaded down the hole.

Smaller chunks such as dry ice nuggets and water ice cubes can be weighed, or measured out volumetrically, to obtain the desired relative proportions, e.g., 60% dry ice/40% water ice cubes by weight. Batches of these two ingredients may be mixed together manually before they are poured down the hole, or they can be poured into the funnel simultaneously so that they flow out simultaneously and blend as they fall down the hole. In a preferred mode of loading, they are measured out volumetrically and poured simultaneously into a chute down which they slide into the funnel, and from there down the well. They can also be poured separately into the hoppers of two augers whose relative speeds have been regulated to feed the two ingredients into the chute at rates that produce the desired mixture. Larger chunks, such as billets of ice or dry ice weighing 1–20 kg. can be counted and dropped down the hole individually.

Promptly after the emplacement of the stemming, the explosive charge is initiated, e.g., with one or more time bombs placed in it prior to the introduction of the stemming, or with one or more explosive boosters detonated by one or more low-energy detonating cords run down the well, or with some combination of these techniques. If detonating cord is used, it is payed out slowly while the stemming is being emplaced so as to prevent the thin cord from becoming too taut and possibly causing the explosive train to separate. When detonating cords are used, it is important that the chunks of ice and dry ice be relatively small and not be frozen together into large masses which can damage the cords upon impact after tumbling down the well.

Prompt initiation of the charge after emplacement of the stemming is important if the stemming is to perform as expected. For wells having a temperature of about 38° C., the charge should be initiated within about three hours after a combination dry ice-water ice stemming has begun to be placed down the hole. The stemming dwell time prior to the explosion can be longer in cooler holes, and may need to be shorter in hotter holes.

The particular type of explosive placed in the hole to be stemmed according to the present method does not form a part of the method of the invention. The explosive may be a high explosive (i.e., an explosive that detonates, such as dynamite) or a low explosive (i.e., an explosive that burns rapidly, such as smokeless powder).

Referring now to the drawing, 1 is a hole which has been drilled into a subsurface formation 2, e.g., a well in a gas-producing formation which is to be stimulated explosively. Explosive charge 3, e.g., a detonating explosive such as dynamite or an explosive water gel, or a deflagrating explosive such as smokeless powder, has been placed at the bottom of hole 1. Time bomb 4 and explosive booster 5 are embedded in charge 3. If the main charge is a low explosive such as smokeless powder, these are preferably flame-producing low-explosives capable of igniting the main charge, but incapable of detonating it. Low-energy detonating cord 6 runs down hole 1 from its collar 1*a*, and is in operative communication with booster 5. Cord 6 is initiated by electric blasting cap 7. Charge 3 is to be initiated by the explosion of booster 5 either by time bomb 4, cord 6, or a combination of the two.

Superimposed on charge 3 is stemming column 8, formed of cold chunk- or nugget-like lumps of a readily liquefiable or vaporizable material such as ice cubes, dry ice nuggets, or a combination thereof. Casing 9 lines hole 1 in the upper portion thereof.

The following examples illustrate various embodiments of the present stemming method, and the results obtained when the method is followed by the detonation of an explosive charge in the stemmed hole.

EXAMPLE 1

A charge of a high-energy water gel explosive 3 containing 30% atomized aluminum, and weighing 40.4 kilograms, was placed in a hole 1 in limestone 2 that was 33.4 meters deep and 152 millimeters in diameter. A layer of vermiculite 0.67 meter deep was placed on top of the charge to keep it from freezing, and then 726 kilograms of dry ice in the form of random-length cylinders 16 millimeters in diameter was poured down the hole to give a column 8 of dry ice stemming 31.3 meters in height.

The charge of water gel explosive was detonated, and the stemming remained in place. The stemming had all sublimed away by the next day, 19 hours later, and the hole was open all the way down and into the cavity produced by the explosion.

EXAMPLE 2

A charge of water gel explosive described in Example 1, weighing 5.68 kilograms, was placed in a hole in limestone that was 30.4 meters deep and 127 millimeters in diameter. Over the charge was poured 227 kilograms of stemming comprising 136 kilograms of dry ice in the form of 16-mm-diameter, random-length cylinders mixed with 90.8 kilograms of ice ($H_2O$) cubes. This produced a stemming column 21.7 meters high.

The charge of water gel explosive was detonated, and the stemming held in place. By the next day, the stemming had disappeared, and the hole was open all the way down and into the cavity produced by the explosion, to a depth of 30.5 meters.

EXAMPLE 3

A charge of the water gel explosive described in Example 1, weighing 193 kilograms, was loaded into the cavity produced by the explosion described in Example 2. Stemming (318 kilograms) of the same composition as that described in Example 2 was poured down the 127-mm-diameter hole on top of the explosive charge to produce a stemming column 29.1 meters high.

When the explosive charge was detonated, the stemming in the 127-mm-diameter hole above it held in place, and detonation gases blew explosively out of a 152-mm-diameter hole that was 9.45 meters away. By the next day, the stemming had disappeared and the 127-mm-diameter hole was open all the way down to a depth of 30.0 meters into the cavity produced by the explosion.

EXAMPLE 4

The cavity produced by the explosion described in Example 3 was partially filled with gravel having a volume equal to that of 400 kilograms of the explosive described in Example 1, and then with 454 kilograms of this explosive. The remainder of the cavity was filled with 127 kilograms of ice ($H_2O$) cubes, and the 127-mm-diameter hole above the cavity was stemmed with 295 kilograms of the stemming composition described in Example 2.

An initial attempt to detonate the charge failed. Thereupon, the stemming was allowed to disappear by sublimation of the dry ice and melting of the ice cubes. The explosive charge was then re-primed, bringing the total charge weight up to 477 kilograms. The hole was then re-stemmed, with 18.2 kilograms of ice cubes directly above the charge in the cavity, and 354 kilograms of the stemming composition described in Example 2. The total height of the stemming column was 29.0 meters. The adjacent 152-mm-diameter hole 9.45 meters away, through which detonation gases had vented explosively in a previous shot (that which is described in Example 3), was stemmed with 309 kilograms of ice ($H_2O$) cubes.

When the charge was detonated, the ice/dry ice stemming above it held in place, as did the stemming of ice cubes in the adjacent 152-mm-diameter hole 9.45 meters away. The detonation gases vented explosively through an unstemmed 254-mm-diameter hole which was 18.9 meters away.

EXAMPLE 5

The 152-mm-diameter hole which vented in the shot described in Example 3 was loaded with 91 kilograms of the explosive described in Example 1. Then 375 kilograms of the 40% ice, 60% dry ice stemming was placed on top of the charge, thereby producing a stemming column 21.9 millimeters in height. A neighboring 127-mm-diameter hole 9.4 meters away was stemmed with a 22.6-meter column of ice ($H_2O$) cubes, and the neighboring 254-mm-diameter hole 9.4 meters away in the opposite direction was stemmed with a 13.4-meter column of ice ($H_2O$) cubes.

When the charge was detonated, the stemming held in place in all three holes, with no noticeable venting of detonation gases from any of them. After the stemming had disappeared from all three holes, they were found to be open all the way to the bottom.

EXAMPLE 6

The cavity produced by the explosion described in Example 5 in the 152-mm-diameter hole was partially filled with gravel to reduce the size of the charge to be emplaced. The same kind of explosive described in the previous examples (272 kilograms) was loaded into the remainder of the cavity but did not completely fill it. The top of the resulting charge was at a depth of 21.8 meters. The remaining cavity volume and the 152-mm-diameter hole above it was filled with 749 kilograms of ice cubes.

The neighboring 127-mm-diameter hole, which was 22.7 meters deep and 9.4 meters away, was filled with 168 kilograms of ice cubes. The neighboring 254-mm-diameter hole, which was 21.1 meters deep and 9.4 meters away, was filled with 381 kilograms of ice cubes in the bottom 12.6 meters, followed by dry ice nuggets in the top 8.4 meters.

When the charge was detonated, the stemming held in place in all three holes. After the stemming had disappeared, the shot hole was open from the surface down into the cavity produced by the explosion, and the satellite holes were open to their original depths.

We claim:

1. In a method of stemming a hole in a subsurface formation at a substantially liquid-free location between the collar of the hole and the top of an explosive charge therein so as to confine the gases produced when said charge is initiated after the hole has been stemmed, the improvement comprising delivering into said hole, at said location, chunks of at least one readily liquefiable and/or vaporizable material, and allowing said chunks to pile up one upon the other and form a columnar bed of pre-solidified material, said solid material having a melting or sublimation temperature at one atmosphere pressure that is (a) sufficiently high that the column of chunks remains in place until, while, and for a period of time after, said charge explodes, and (b) sufficiently low that, after the explosion, said column melts and/or sublimes on standing.

2. A method of claim 1 wherein said chunks are dropped into said hole.

3. A method of claim 1 wherein said chunks are adapted to form a column which, filling the cross-section of a 152-mm diameter hole, remains in place when said charge explodes after standing in said hole in a 40° C. formation for several hours.

4. A method of claim 1 wherein a wadding is placed between said explosive charge and said column of chunks.

5. A method of claim 4 wherein said wadding is temporarily gelled water.

6. A method of claim 1 followed by the steps of initiating said explosive charge and thereafter allowing said chunks to melt and/or sublime, whereby said hole is open.

7. A method of claim 1 wherein said explosive charge is placed in the hole and the formation pre-cooled before said chunks are delivered into the hole to form said column, said pre-cooling being accomplished by introducing dry ice into the hole and letting it sublime partially or completely.

8. A method of claim 1 wherein said chunks delivered into said hole are chunks of ice (water) and chunks of dry ice.

9. A method of claim 1 wherein said chunks delivered into said hole are chunks of ice.

10. A method of claim 1 wherein said chunks delivered into said hole are chunks of dry ice.

11. A method of claim 1 wherein said chunks delivered into said hole are chunks of sulfur.

12. A method of claim 11 wherein said hole is a geothermal well.

13. A method of claim 2 wherein projecting members are embedded in at least some of said chunks to keep them from contacting the wall of the hole while falling.

14. A method of claim 2 wherein at least some of said chunks are placed in net bags to keep them from contacting the wall of the hole while falling.

15. A method of claim 8 wherein the ratio of dry ice chunks to water ice chunks, by weight, is about from 1/1 to 2.3/1.

16. A method of claim 8 wherein said hole is a gas well.

17. A method of claim 8 wherein said hole is in an ore body to be leached.

18. A method of claim 17 wherein at least one unloaded hole adjacent to said hole is stemmed in the same manner.

19. A method of claim 8 wherein the height of said column is at least about 140 times the diameter of said hole.

20. A method of claim 8 wherein said chunks of ice (water) are ice cubes kept cold until hole loading time by storage in an insulated container containing dry ice.

21. A method of claim 8 wherein the ratio of dry ice chunks to water ice chunks decreases with distance from said explosive charge.

22. A method of claim 21 wherein said column comprises a lowest section of substantially all dry ice chunks adjacent the top of the explosive charge in the hole, covered by a section of substantially all ice (water) chunks.

23. A method of claim 21 wherein said column comprises a lowest section of a mixture of ice (water) chunks and dry ice chunks, covered by a section of substantially all ice (water) chunks.

24. A method of claim 21 wherein said column comprises a lowest section of substantially all dry ice chunks adjacent the top of the explosive charge in the hole, covered by one or more sections comprising a mixture of ice (water) chunks and dry ice chunks.

25. A method of claim 24 wherein the section(s) comprising a mixture of ice (water) chunks and dry ice chunks are covered by a section comprising only ice (water) chunks.

26. In a borehole, a stemming column located between the collar of the hole and the top of an explosive charge therein, said stemming column comprising cold chunks piled up one upon the other and selected from the group consisting of (1) a column of ice chunks; (2) a column of a mixture of ice chunks and chunks of dry ice; (3) a column having a bottom section comprising a mixture of ice chunks and chunks of dry ice covered by a section comprising ice chunks; (4) a column having a bottom section comprising chunks of dry ice covered by a section comprising (a) ice chunks, (b) a mixture of ice chunks and chunks of dry ice, or (c) a mixture of ice chunks and chunks of dry ice covered by a section comprising ice chunks.

27. The stemming column of claim 26 wherein said ice chunks have been pre-chilled outside of said borehole by storage in dry ice.

* * * * *